US012662847B2

(12) United States Patent
Hauge et al.

(10) Patent No.: US 12,662,847 B2
(45) Date of Patent: Jun. 23, 2026

(54) PEG SHIFTER AND METHOD OF USING THEREOF

(71) Applicant: SUNWEST INDUSTRIES INC., Orange, CA (US)

(72) Inventors: Reed Hauge, Irvine, CA (US); Louis Divito, Placentia, CA (US); David Woods, Fullerton, CA (US)

(73) Assignee: SUNWEST INDUSTRIES INC., Orange, CA (US)

( * ) Notice: Subject to any disclaimer, the term of this patent is extended or adjusted under 35 U.S.C. 154(b) by 264 days.

(21) Appl. No.: 18/680,345

(22) Filed: May 31, 2024

(65) Prior Publication Data

US 2025/0369251 A1 Dec. 4, 2025

(51) Int. Cl.
*E04H 17/22* (2006.01)

(52) U.S. Cl.
CPC ..... *E04H 17/22* (2013.01)

(58) Field of Classification Search
CPC ..... E04H 17/009; E04H 17/013; E04H 17/20; E04H 17/21; E04H 17/22; E06B 11/02; E06B 11/023; E06B 11/026; E06B 11/028; Y10T 403/7047
See application file for complete search history.

(56) References Cited

U.S. PATENT DOCUMENTS 6,666,435 B2 * 12/2003 Blosfelds ..... E06B 11/02 256/73
9,410,348 B1 * 8/2016 Flannery ..... E06B 11/02
2019/0085589 A1 * 3/2019 McKinney ..... E04H 17/1439
2022/0316234 A1 * 10/2022 Cogburn ..... E04H 17/20
2024/0209687 A1 * 6/2024 Bragnalo ..... E06B 11/026

FOREIGN PATENT DOCUMENTS

KR 20120105093 A * 9/2012 ..... E02D 27/42

* cited by examiner

*Primary Examiner* — Jonathan P Masinick
(74) *Attorney, Agent, or Firm* — DANE IP Law PC

(57) ABSTRACT

The installation of a pool fence, specifically a pool gate, requires the drilling of installation holes on the ground near the pool. If the distance between the installation holes for the pool gate does not equal the distance between the pegs coupled to the pool gate, a peg shifter may be used that has an adjustable peg that can shift to change the location of the peg to make equal the two aforementioned distances when the peg shifter is coupled to the pool gate. The adjustability of the location of the peg when coupled to the pool gate may be accomplished by restructuring the body of the peg shifter to off-center the peg. Such restructuring of the body of the peg shifter may be done by removing a shim attached to one side of the peg shifter to the opposite side.

20 Claims, 10 Drawing Sheets

FIG. 1B

PEG SHIFTER AND METHOD OF USING THEREOF

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various aspects and embodiments described herein relate to a peg shifter and method of using thereof.

Swimming pools filled with water may create a drowning hazard for children if the pool is not childproofed. Installing a mesh pool fence around the swimming pool may be one method used for childproofing the swimming pool. However, installing the mesh pool fence may be difficult, especially installing the pool gate.

Accordingly, there is a need in the art for an improved device, system, and method for installing mesh pool fences.

BRIEF SUMMARY

The various embodiments and aspects disclosed herein address the needs discussed above, discussed below and those that are known in the art.

A peg shifter and method of using thereof is disclosed. The installation of a pool fence, specifically a pool gate, requires the drilling of installation holes on the ground near the pool. The distance between the pair of installation holes for a pair of pegs coupled to the vertical poles of the pool gate need to be accurately spaced from each other. Otherwise, the pegs of the fence will not match the holes in the ground and the pegs cannot be mounted therein. As described herein, the distance between the two pegs may be adjustable to equal to the distance between the holes in the ground. By way of example and not limitation, if the distance between the installation holes for the pool gate does not equal the distance between the pegs coupled to the pool gate, one or more peg shifters may be used to modify the distance between the pegs. The peg shifter may have a peg that may be adjustable to shift the location of the peg to modify the distance between the pegs so that such distance is equal to the distance between the installation holes.

The adjustability of the location of the peg when coupled to the pool gate may be accomplished by restructuring the body of the peg shifter to off-center the peg and increase or decrease the distance between the peg shifters. Such restructuring of the body of the peg shifter may be done by removing a shim attached to one side of the peg shifter and reattaching the shim to the opposite side. The repositioning of the shim may shift the peg to one side of the main body of the device. Such shift may achieve the desired distance between the pegs of the pool gate when the peg shifter is inserted in a receiving cavity of the vertical pole of the pool gate.

More particularly, a peg shifter for coupling to a receiving cavity of a pool gate is disclosed. The peg shifter may have a main body having a rectangular shape, the main body having a first longitudinal face and a second longitudinal face, and a base therebetween, the first and second longitudinal faces being opposing lateral faces of the rectangular shape, one or more engagement members on the first longitudinal face of the main body, one or more second engagement members on the second longitudinal face of the main body, a peg attached to the base of the main body and extending from the base, and a shim having a thickness and one or more corresponding engagement members on an outer surface of the shim, the one or more corresponding engagement members configured to removably couple to the one or more engagement members of the first longitudinal face of the main body and also removably couple to the one or more second engagement members on the second longitudinal face of the main body, wherein when the shim is coupled to the first longitudinal face of the main body, the peg is centered about a cross-section of the peg shifter defined by the base of the main body and the thickness of the shim, and wherein when the shim is coupled to the second longitudinal face of the main body, the peg is shifted off-center about the cross-section of the peg shifter by a distance equaling the thickness of the shim.

In some embodiments, an insertion hole extends through the main body from the first longitudinal face to the second longitudinal face.

In some embodiments, the thickness of the shim ranges between 0.1 to 0.2 inches.

In some embodiments, the peg shifter has a notch on the second longitudinal face of the main body and proximate to the peg.

In some embodiments, the one or more engagement members and the one or more second engagement members on the main body are coupling holes and the one or more corresponding engagement members on the shim are coupling tabs.

In some embodiments, the main body is made from a thermoplastic and the peg is made from stainless steel.

In some embodiments, when the shim is coupled to the main body, the cross-section of the peg shifter is a square shape.

In some embodiments, the shim is a first shim and the peg shifter further has a second shim having a second thickness that is greater than the first thickness of the first shim.

In some embodiments, the coupling of the one or more corresponding engagement members on the shim with the one or more engagement members on the first longitudinal face of the main body is done through an annular snap-fit joint mechanism. In some embodiments, the coupling of the one or more corresponding engagement members on the shim with the one or more second engagement members on the second longitudinal face of the main body is done through a second annular snap-fit joint mechanism.

Furthermore, a method for using a peg shifter to install a pool gate to a ground floor is disclosed, the method including detaching a removable shim from a main body of the peg shifter by separating one or more corresponding engagement members that are on the removable shim from one or more engagement members on a first longitudinal face of the main body, the main body having a rectangular shape, attaching the removable shim to a second longitudinal face of the main body by coupling the one or more corresponding engagement members of the shim to one or more second engagement members on the second longitudinal face of the main body, the second longitudinal face being opposite to the first longitudinal face of the main body, wherein attaching the removable shim to the second longitudinal face of the main body shifts a first peg extending from the main body off-center relative to a cross-section defined by a base of the main body and a body thickness of the shim, coupling the peg shifter to a first receiving cavity located on a bottom section of the pool gate such that the first peg extends downwards from the pool gate, coupling a second peg to a second receiving cavity located on the bottom section of the pool gate such that the second peg extends downwards from the pool gate, and inserting the first peg into a first installation hole and inserting the second peg into a second installation hole on the ground floor.

In some embodiments, the peg shifter is coupled to the first receiving cavity using an insertion hole on the peg shifter and a corresponding insertion hole extending through the first receiving cavity.

In some embodiments, the method further includes rotating the peg shifter by 180-degrees after attaching the removable shim to the second longitudinal face of the main body.

In some embodiments, the second peg is attached to a second peg shifter for coupling to the second receiving cavity located on the bottom section of the pool gate.

In some embodiments, the first longitudinal face of the main body is distinguishable from the second longitudinal face by a notch on the second longitudinal face.

In some embodiments, the body thickness of the shim ranges between 0.1 to 0.2 inches.

In some embodiments, the one or more engagement members and the one or more second engagement members on the main body are coupling holes and the one or more corresponding engagement members on the shim are coupling tabs.

In some embodiments, the main body is made from thermoplastic and the first peg is made from stainless steel.

In some embodiments, the detaching of the removable shim from the first longitudinal face of the main body is done through an annular snap-fit joint mechanism between the one or more corresponding engagement members on the removable shim and the one or more engagement members on the first longitudinal face of the main body. In some embodiments, the attaching of the removable shim to the second longitudinal face of the main body is done through a second annular snap-fit joint mechanism between the one or more corresponding engagement members on the removable shim and the one or more second engagement members on the second longitudinal face of the main body.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
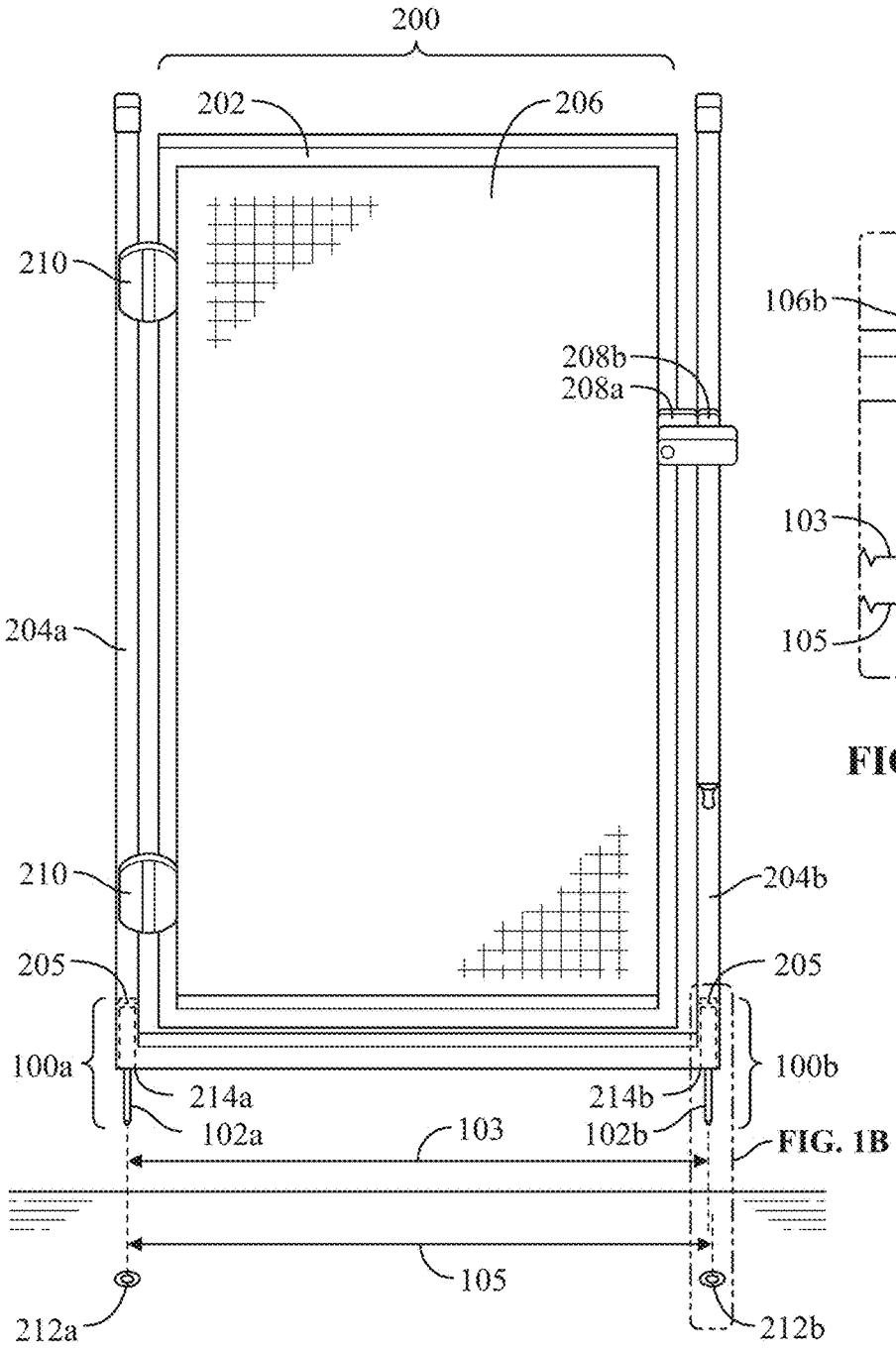
FIG. 1A shows a pool gate having peg shifters and the pegs at a different distance than the installation holes on the ground.
Figure 1B:
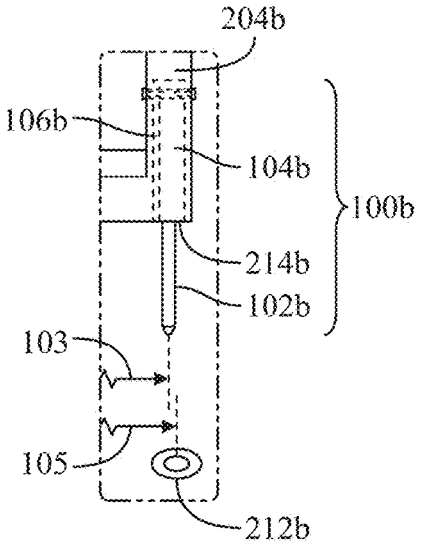
FIG. 1B shows a close-up view of a peg of a peg shifter coupled to the pool gate in FIG. 1A being misaligned with the installation hole.
Figure 1C:
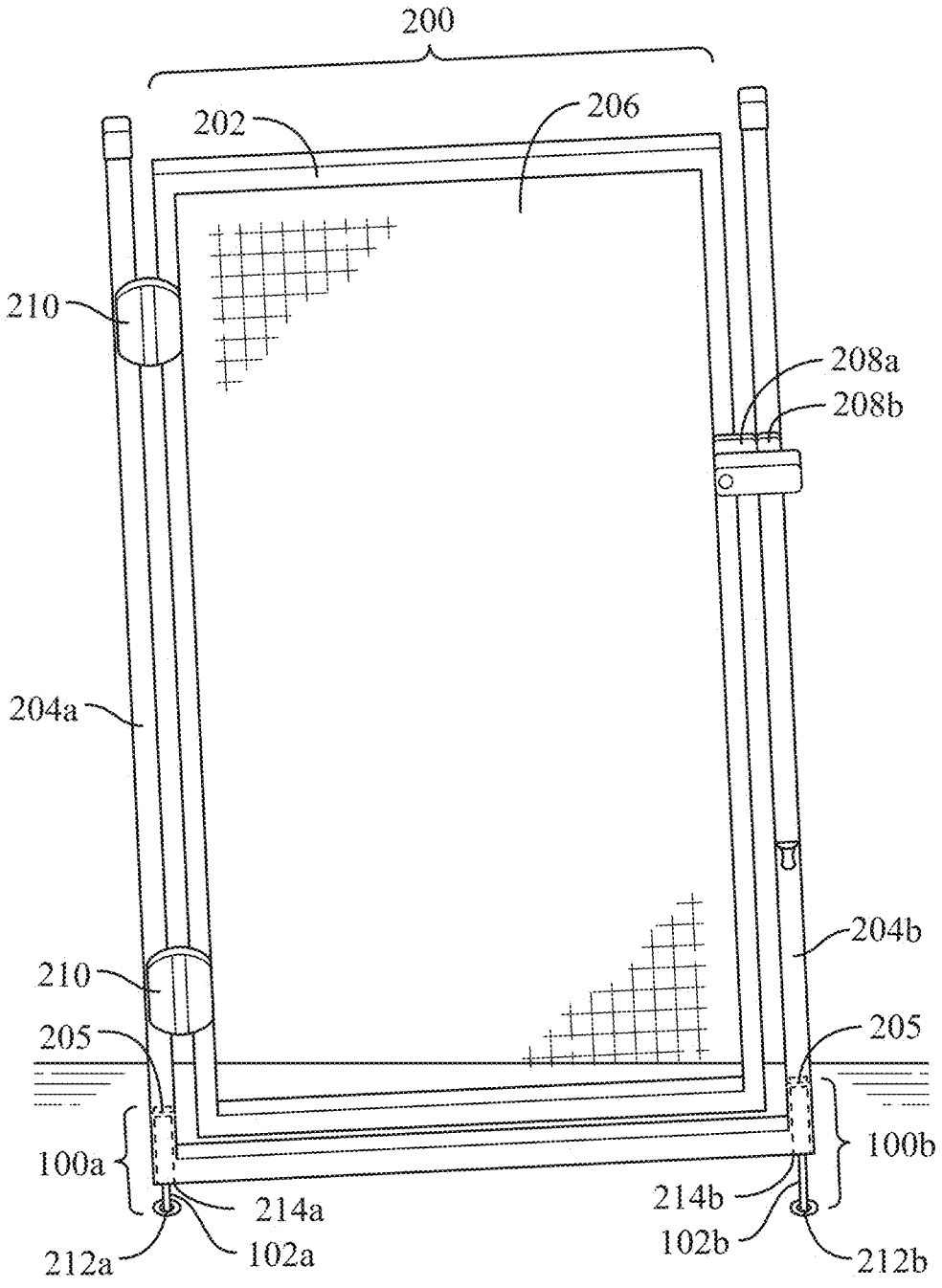
FIG. 1C shows the pool gate of FIG. 1A not installed properly because of the discrepancy in the distances between the pegs and the installation holes.
Figure 1D:
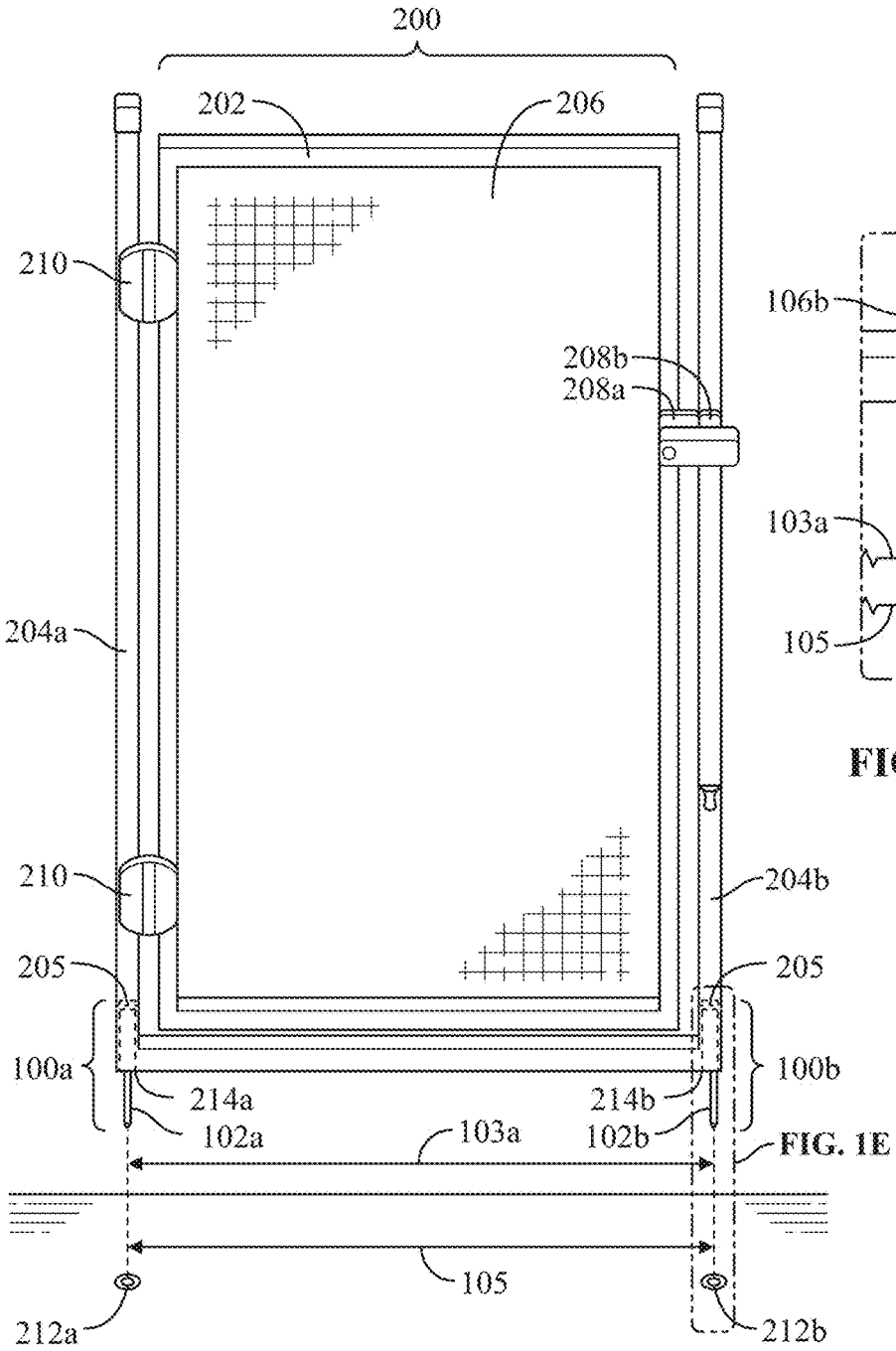
FIG. 1D shows the pool gate of FIG. 1A having the pegs of the peg shifter adjusted to a new distance equaling the distance between the installation holes.
Figure 1E:
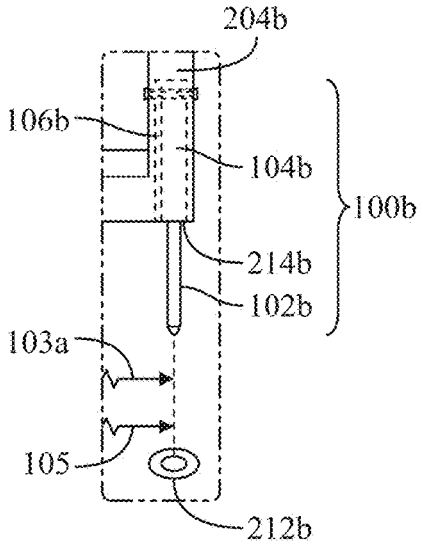
FIG. 1E shows a close-up view of the peg of the peg shifter coupled to the pool gate in FIG. 1D aligned with the installation hole.
Figure 1F:
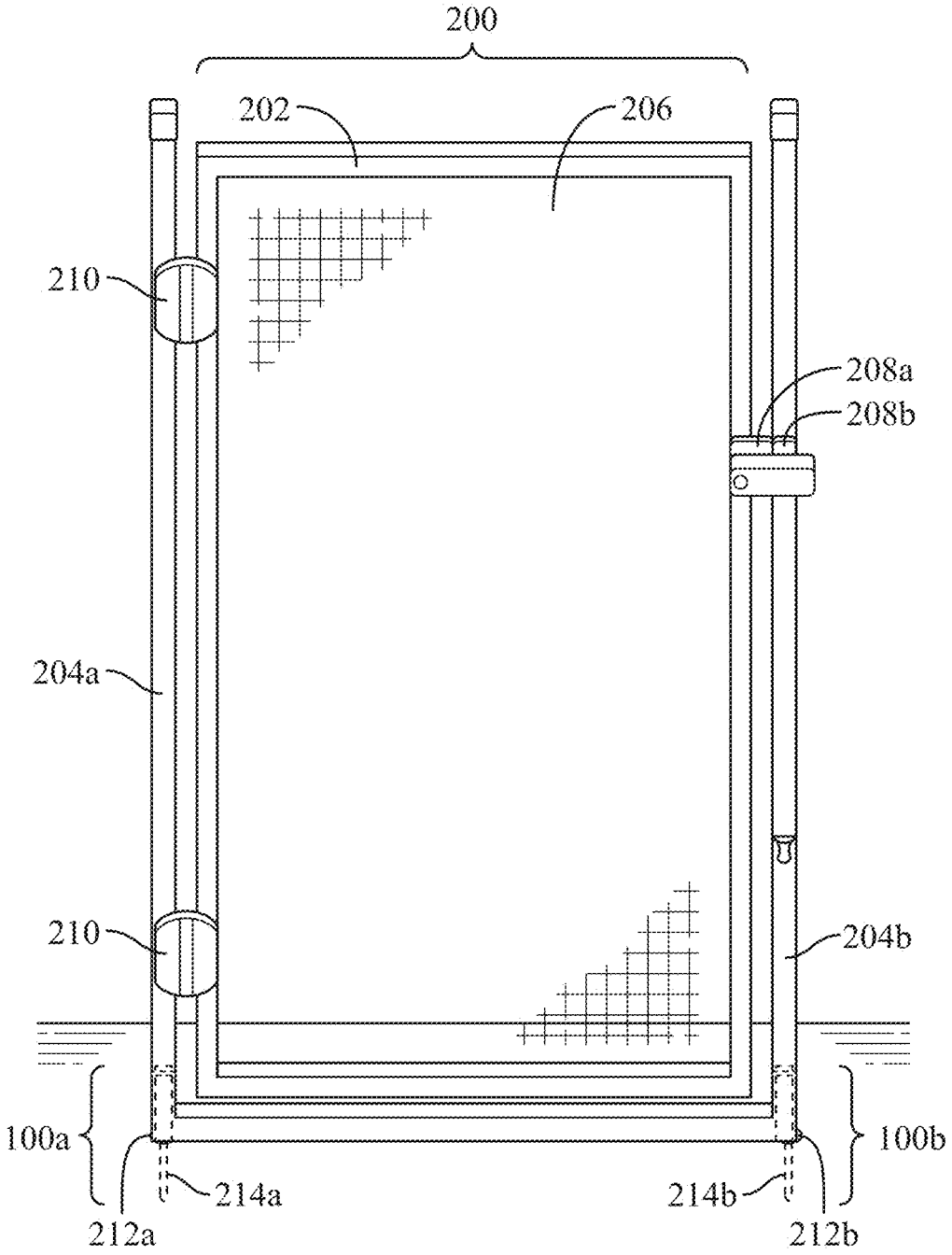
FIG. 1F shows the pool gate installed properly to the ground because of the adjustment done in FIG. 1D.
Figure 1G:
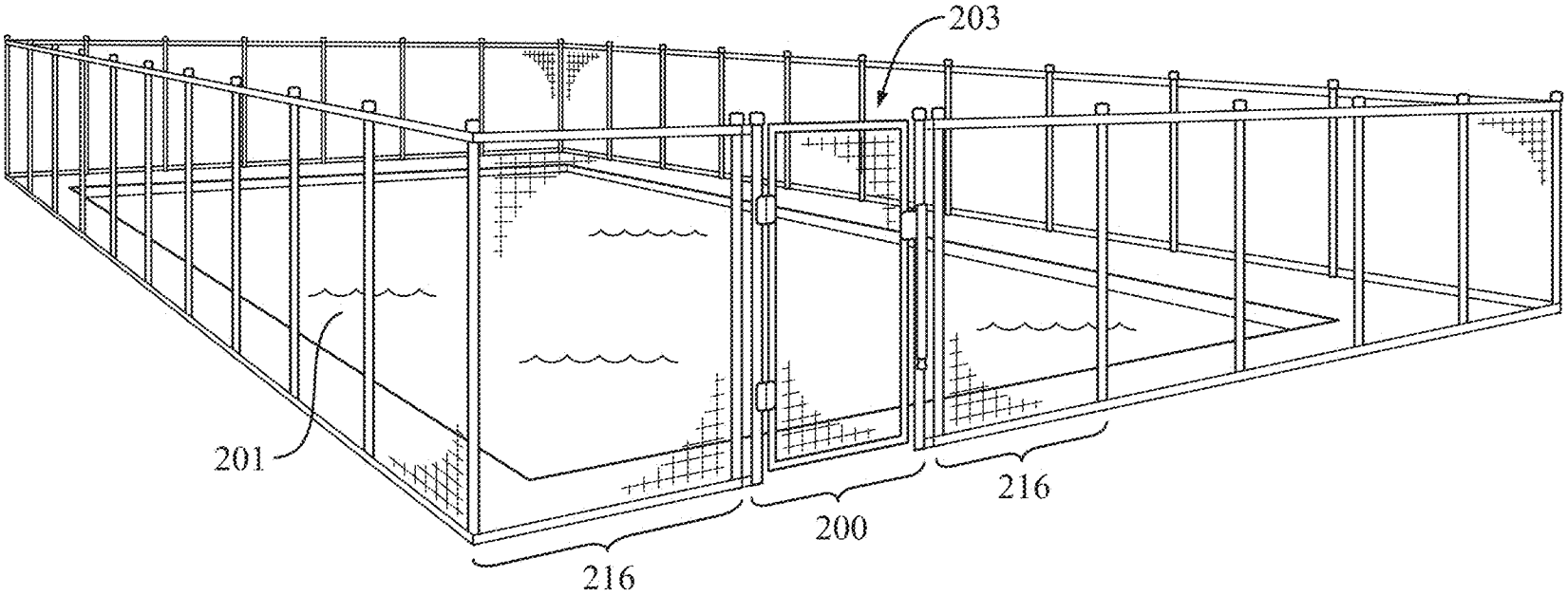
FIG. 1G shows the pool gate of FIG. 1F part of a pool fence assembly around a pool.
Figure 2:
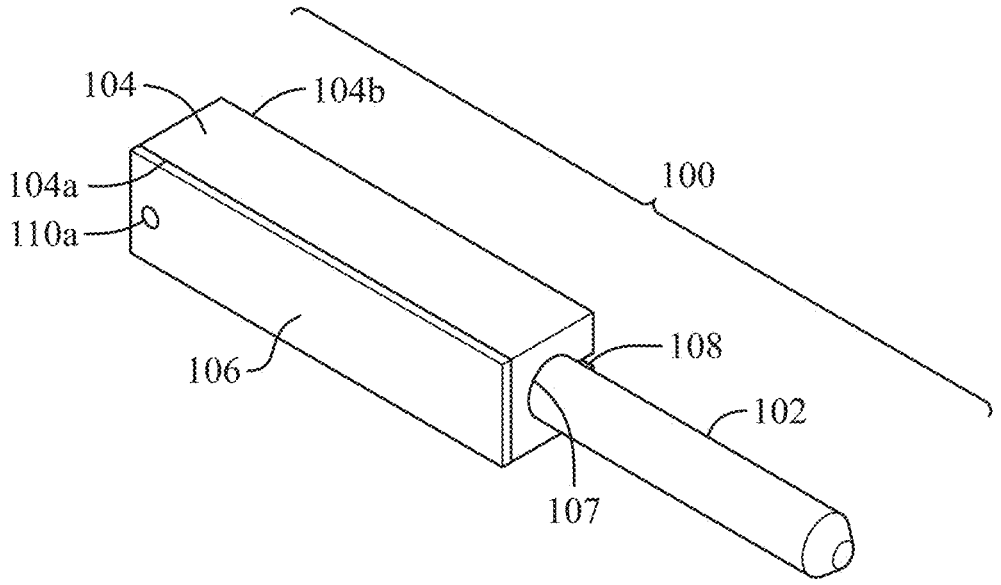
FIG. 2 shows a perspective view of the peg shifter used in FIGS. 1A-F.
Figure 3A:
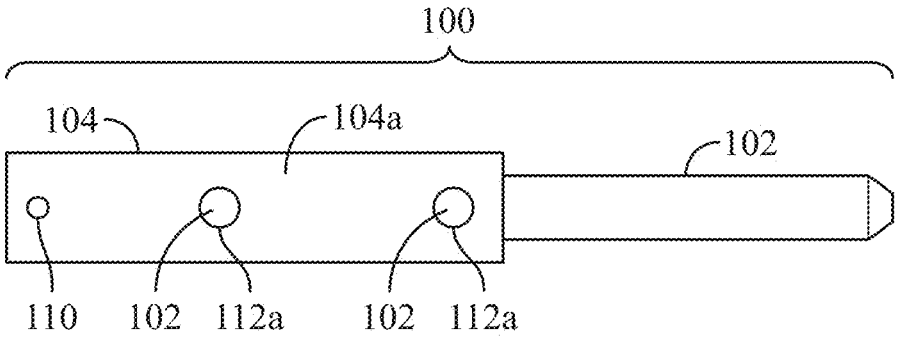
FIGS. 3A-B show a first and second side view of the peg shifter of FIG. 2.
Figure 3B:
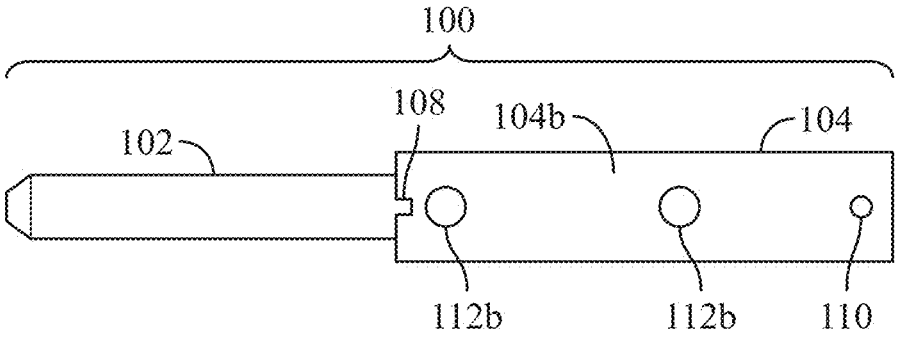
Figure 3C:
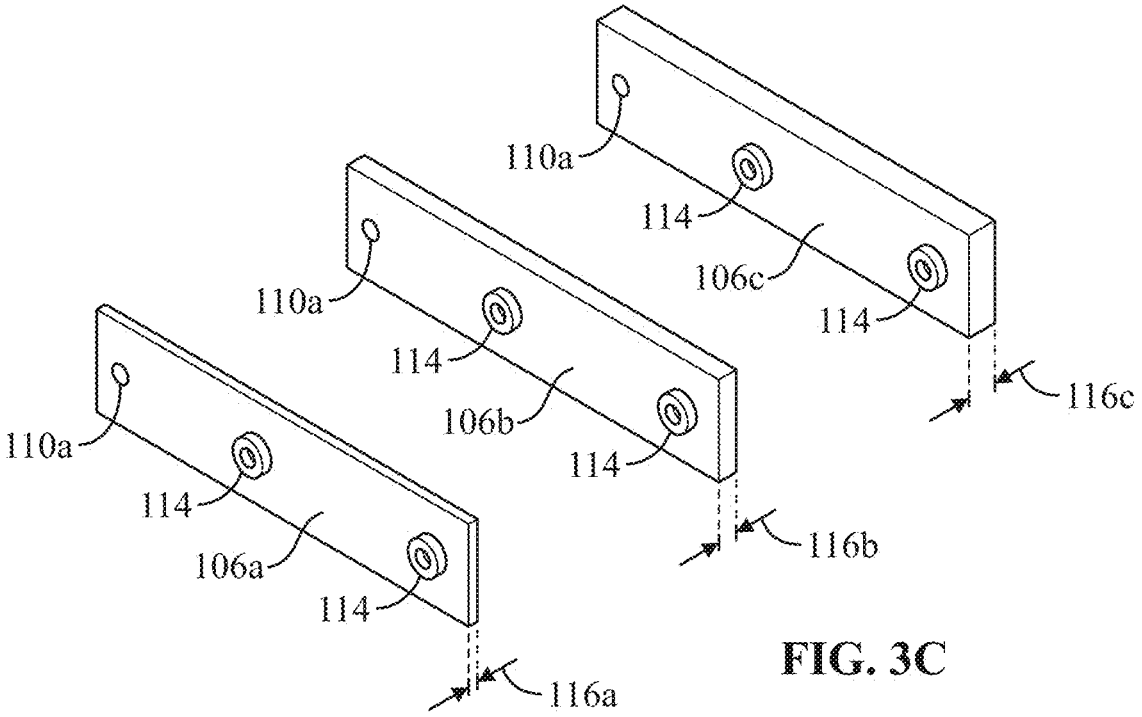
FIG. 3C shows multiple shims with different thicknesses that are attachable to the peg shifter of FIG. 2.
Figure 4:
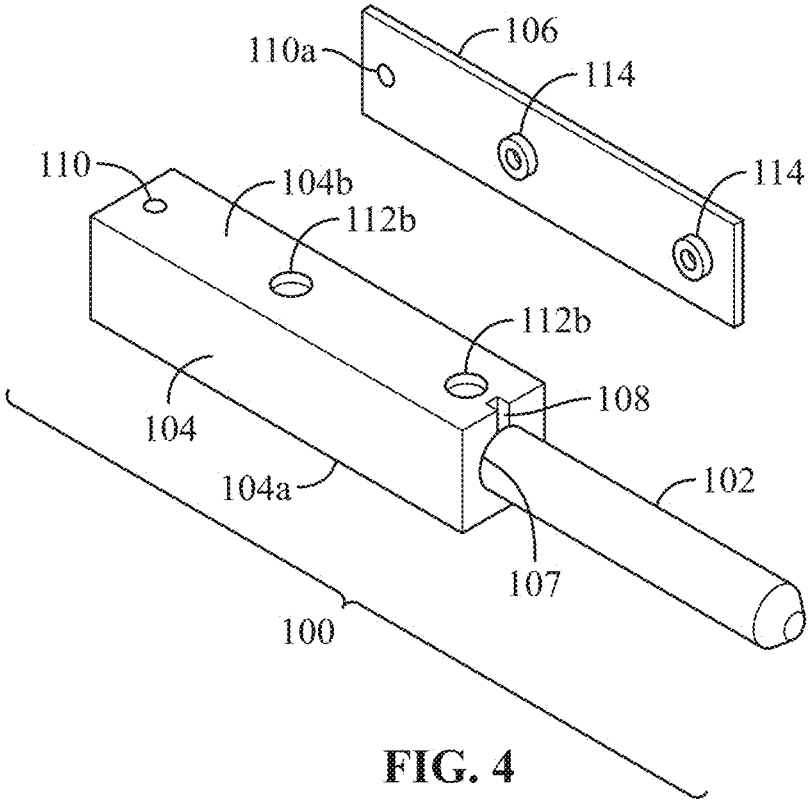
FIG. 4 shows the peg shifter of FIG. 2 with the shim detached.

Referring now to the figures, a peg shifter 100 (see FIG. 2) and a method of using thereof is disclosed. As shown in FIG. 1A, the installation holes 212*a-b* on the ground may be drilled improperly such that the distance 105 between the installation holes 212*a-b* does not equal the distance 103 between the pegs 102*a-b* of the peg shifters 100*a-b*. The distance 103 between the pegs 102*a-b* of the peg shifters 100*a-b* shown in FIG. 1A may be based on the factory design and dimensions of the pool gate 200, which such components are coupled thereof. Consequently, FIG. 1B shows how the peg 102*b* of a peg shifter 100*b* coupled to the pool gate 200 is misaligned with an installation hole 212*b*. Additionally, FIG. 1C shows how the pool gate 200 does not install properly because of the inequality in the distance 103 between the pegs 102*a-b* and the distance 105 between the installation holes 212*a-b*. FIGS. 1D-E show the implementation of the adjusting function of the one or more peg shifters 100*a-b* such that the pegs 102*a-b* are shifted to a new adjusted distance 103*a* that equals the distance 105 between the installation holes 212*a-b*. As a result, the pool gate 200 may be installed properly as shown in FIG. 1F. The pool gate 200 may be a part of a pool fence assembly 203 (see FIG. 1G) enclosing a pool 201 for safety reasons. As shown in FIG. 2, the peg shifter 100 used to modify the distances in FIGS. 1A-F may have at least three main components: the main body 104, the peg 102, and the shim 106. FIGS. 3A-B show how the longitudinal sides 104*a-b* of the main body 104 may have a plurality of coupling holes 112*a-b* to allow for the attachment of the shim 106 for shifting the peg 102 relative to the cross-section of the peg shifter 100. FIG. 3C shows how the shim 106*a-b* may come in different thicknesses 116*a-c*, and FIG. 4 shows the attachment relation between the shim 106 and the main body 104 of the peg shifter 100. A method 500 of using one or more peg shifters 100 is shown in the block diagram of FIG. 5. As shown in FIGS. 6A-C, the shim 106 may be adjusted relative to the main body 104 to shift the peg 102 off-center relative to the combined cross-section of the shim 106 and the main body 104. The peg shifter 100 may also be rotated by 180-degrees to reverse the off-center orientation of the peg 102 (e.g., from leftwards to rightwards). The one or more peg shifters 100 may also be used with other structures, such as a gate post 300 (see FIG. 7).

Referring specifically now to Figures IA-F, the remedying of an improper installation of a pool gate 200 is shown. By way of example and not limitation, one or more peg shifters 100*a-b* may be used to adjust the positioning of the pegs

102*a-b* for proper insertion in the installation holes 212*a-b* on a ground surface. By way of example and not limitation, the pool gate 200 may be part of a pool fence assembly 203, shown in FIG. 1G, surrounding a pool 201 to protect people, specifically toddlers and young children, from accidentally falling in the pool 201. In addition to the the pool gate 200, and by way of example and not limitation, the pool fence assembly 203 may have a plurality of fence sections 216 attached together and to the pool gate 200 and surrounding the pool 201.

Referring back to FIG. 1A, the factory designed distance 103 between the removable pegs 102*a-b* (i.e., when the removable pegs 102*a-b* are centered about the body of the peg shifters 100*a-b*) need to be approximately equal to the distance 105 between the installation holes 212*a-b* drilled in the ground (or deck) surrounding the pool 201. If the distance 105 between the installation holes 212*a-b* is different than the factory designed distance 103 between the pegs 102*a-b* (e.g., distance 105 is longer or shorter than second distance 103), then the pegs 102*a-b* coupled to the vertical poles 204*a-b* of the pool gate 200 may not be fully inserted inside the installation holes 212*a-b*. This may be because one or more pegs 102*b* may be misaligned with one or more installation holes 212*b* (see FIG. 1B). Consequently, the pool gate 200 may not be properly and securely installed to the ground. As a result, and as shown in FIG. 1C, the pool gate 200 may be slanted and wobble or, in extreme cases, both of the pegs 102*a-b* may not be capable of being inserted simultaneously in the two installation holes 212*a-b* on the ground.

FIGS. 1A-C show an example of such discrepancy in the two distances where the distance 105 between the installation holes 212*a-b* on the ground is longer than the distance 103 between the removable pegs 102*a-b*. Consequently, both pegs 102*a-b* may not be properly inserted inside the installation holes 212*a-b* at the same time. Such discrepancy in the two distances 103, 105 may be caused by a user not drilling the installation holes 212*a-b* on the ground at the correct distance, but at a longer distance than the distance 103 between the pegs 102*a-b*. Alternatively, the installation holes 212*a-b* may be drilled to the ground at a shorter distance than the distance 103 between the pegs 102*a-b*, which may create a similar type of problem in installing the pool gate 200 to the installation holes 212*a-b* using the pegs 102*a-b*. The distance 103 between the pegs 102*a-b* may be pre-determined and unchangeable without the usage of the peg shifter 100*a-b* since conventional pegs coupled to the pool gate 200 may not have their positions adjustable.

The peg shifters 100*a-b* shown in FIGS. 1A-F may have adjustable pegs 102*a-b* to address solving the aforementioned problems of not drilling the installation holes 212*a-b* at the correct distance. As shown in FIGS. 1D-E, and by way of example and not limitation, the one or more peg shifters 100*a-b* may be adjusted to shift the position of the pegs 102*a-b* within the receiving cavities 214*a-b*, and relative to the installation holes 212*a-b*, to create a second distance 103*a* (see FIG. 1D) between the pegs 102*a-b*. The second distance 103*a* may equal the distance 105 between the installation holes 212*a-b* because at the new distance the pegs, such as second peg 102*b* (see FIG. 1E), align with the installation holes, such as the second installation hole 212*b*. As such, the pool gate 200 may be properly installed to the ground surface, as shown in FIG. 1F. By way of example and not limitation, the first and second distances 103, 103*a* between the pegs 102*a-b* may be measured from a cross-sectional center of one peg 102*a* to the cross-sectional center of the second peg 102*b*. By way of example and not limitation, the distance 105 between the installation holes 212*a-b* may be measured from a center of one installation hole 212*a* to the center of the second installation hole 212*b*. For sake of clarity in the figures, the shifting of the peg 102*b* of the peg shifter 100*b* between FIGS. 1A and ID, to achieve desired distance 103*a*, has been exaggerated. In real-world applications, and by way of example and not limitation, the peg 102*b* may be shifted by a fraction of an inch, as described elsewhere herein.

By way of example and not limitation, the pool gate 200 may have a rectangular outer frame having two vertical poles 204*a-b* as the longitudinal sides of the outer frame. By way of example and not limitation, each bottom of the vertical poles 204*a-b* may be hollow and have a receiving cavity 214*a-b* for a peg shifter 100*a-b* to be inserted therein. FIGS. 2-4 show the structural features of the peg shifter 100 in detail. By way of example and not limitation, the receiving cavities 214*a-b* at the bottom of the vertical poles 204*a-b* may have a square or rectangular opening and space. By way of example and not limitation, the outer sides of the vertical poles 204*a-b* of the pool gate 200 may have engagement holes 205 extending inside the receiving cavities 214*a-b*. As described elsewhere herein, and by way of example and not limitation, the peg shifter 100 (see FIG. 2) may have a corresponding engagement hole 110 to fasten to the inside of the receiving cavities 214*a-b* using the engagement hole 205 on each vertical pole 204*a-b*.

Referring to the rest of the body of the pool gate 200, and by way of example and not limitation, a mesh frame 202 may be located between the two vertical poles 204*a-b*. By way of example and not limitation, the mesh frame 202 may be hinged to a first vertical pole 204*a* using one or more hinges 210. By way of example and not limitation, the other side of the mesh frame 202 opposite to the hinges 210 may be interlocked with a second vertical pole 204*b* of the pool gate 200 using a gate lock 208*a-b*. By way of example and not limitation, the latching component 208*a* may be on the mesh frame 202 and the catch component 208*b* may be on the second vertical pole 204*b*, or vice versa. Between the rectangular mesh frame 202 there may exist a mesh covering 206 that may be see-through.

Referring now to FIGS. 2-4, the structural features of the peg shifter 100 that acts as the distance adjusting device for the installation of the pool gate 200 are shown. By way of example and not limitation, the peg shifter 100 may have a main body 104 where the other structural components, such as the shim 106 and the peg 102 may be attached thereto. With further reference to FIG. 1D, and by way of example and not limitation, the main body 104 (see FIG. 2) may be the component of the peg shifter 100 inserted in the receiving cavities 214*a-b* for coupling with the pool gate 200. By way of example and not limitation, the peg 102 (see FIG. 2) attached to and extending from the main body 104 may be the component of the peg shifter 100 inserted in the installation holes 212*a-b* (see FIG. 1F) for mounting the pool gate 200. By way of example and not limitation, the shim 106 (see FIG. 2) attached on the side of the main body 104 of the peg shifter 100 may be the component used to adjust the device to compensate for the discrepancy for the distance 103 between the two pegs 102*a-b* not being equal to the distance 105 between the two installation holes 212*a-b*.

As shown in FIG. 2, and by way of example and not limitation, the main body 104 may have a square prism or rectangular prism shape with a square, quasi-square, or rectangular cross-section (i.e., base). As shown in FIGS. 6A-C, and by way of example and not limitation, the main body 104 may have close to a square cross-section (i.e., base), and hence a quasi-square cross-section. The length of the cross-section of the main body 104 may be less than the height so that when the shim 106 is attached to the side of the main body 104, a square cross-section is formed with the thickness 116 of the shim 106 combined to the length of the main body 104. By way of example and not limitation, the combined cross-section of the main body 104 and the shim 106 being square-shaped may be needed for the device to fit inside the receiving cavities 214*a-b* that may have square openings. Alternatively, the main body 104 may have a square cross-section (i.e., base), and the attachment of the shim 106 may give the combined cross-section of the main body 104 and the shim 106 a rectangular length. As shown in FIG. 2, the rectangular or square prism shape of the main body 104 may have a first longitudinal side 104*a* opposite to a second longitudinal side 104*b*, the first and second longitudinal sides 104*a-b* being opposing lateral faces of the prism shape of the main body 104. By way of example and not limitation, the first longitudinal side 104*a* may be a left side of the main body 104 and the second longitudinal side 104*b* may be the right side of the main body 104. By way of example and not limitation, the main body 104 may be made from a rigid polymer material, such as a thermoplastic (e.g., polycarbonates and polyvinyl chloride). By way of example and not limitation, the main body 104 may also be made from a metal alloy (e.g., steel, aluminum, titanium).

As shown in FIGS. 3A-B, and by way of example and not limitation, the first and second longitudinal sides 104*a-b* may each have one or more coupling holes 112*a-b* for the attachment of the shim 106, as described elsewhere herein. The one or more coupling holes 112*a-b* may be designed to allow the shim 106 to attach to the side of the main body 104 using corresponding one or more coupling tabs 114 (see FIG. 4) on the side of the shim 106. By way of example and not limitation, the one or more coupling holes 112*a-b* may be part of an annular snap-fit joint coupling mechanism between the main body 104 and the shim 106. By way of example and not limitation, each longitudinal side 104*a-b* of the main body 104 may have between one to six coupling holes 112*a-b*. Alternatively, the placement of the coupling holes 112*a-b* may be reversed with the coupling tabs 114 where one or more coupling holes 112*a-b* may be on the shim 106 and the longitudinal sides 104*a-b* of the main body may each have coupling tabs 114. Other coupling mechanisms between the main body 104 and the shim 106 are also contemplated herein, such as magnetic coupling or the usage of fasteners (screws or bolts) and fastening holes between the two components.

As shown in FIGS. 3A-B, and by way of example and not limitation, the coupling holes 112*a-b* (e.g., two coupling holes 112*a-b*) may be centered between the height of the longitudinal sides 104*a-b*. By way of example and not limitation, the coupling holes 112*a-b* may also be centered about the length of the longitudinal sides 104*a-b* or be shifted slightly forward towards the notch 108 when compared to the engagement hole 110. As shown in FIG. 3A, and by way of example and not limitation, the first coupling holes 112*a* on the first longitudinal side 104*a* may reach the portion of the peg 102 inserted in the main body 104, and the peg 102 may be visible through the first coupling holes 112*a*. The visibility of the peg 102 through the first coupling holes 112*a* may be because of how the shim 106 is designed to be originally attached to the first longitudinal side 104*a* to center the peg 102 (see FIG. 6A). The visibility of the peg 102 through the first coupling holes 112*a* may serve to distinguish the first longitudinal side 104*a* from the second longitudinal side 104*b*. Consequently, the peg 102 may not be visible through second coupling holes 112*b* on the second longitudinal side 104*b* (see FIG. 3B) and there may be a portion of the main body 104 therebetween. Alternatively, the peg 102 may also be visible through the second coupling hole 112*b* as is through the first coupling hole 112*a*. Alternatively, the peg 102 may be closed off from the first coupling holes 112*a* as is closed off from the second coupling holes 112*b*.

As shown in FIG. 2, and by way of example and not limitation, the front face of the main body 104 may have an insertion hole 107 for the insertion and attachment of the peg 102. As described elsewhere herein, the shape of the cross-section (i.e., base) of the main body 104 may be square, quasi-square, or rectangular. By way of example and not limitation, the peg 102 may be inserted in the insertion hole 107 and be irremovably affixed to the main body 104 or be removably attached the main body 104 via the insertion hole 107. By way of example and not limitation, the peg 102 may be irremovably affixed to the main body 104 using an adhesive (e.g., epoxy) between the body of the peg 102 and the inside of the insertion hole 107. The permanent fixture of the peg 102 to the main body 104 may further ensure the peg shifter 100 does not get dismantled and, consequently, the pool gate 200 (see FIG. 1F) stays mounted in the desired location. By way of example and not limitation, the peg 102 may be removably attached to the main body 104 where the rear end of the peg 102 may be threaded and the inner end of the insertion hole 107 may be correspondingly threaded. The removable feature of the peg 102 from the main body 104 may allow for the replacement of the peg 102 if such structure gets bent or damaged or reusing old pegs from other pool gate mounting mechanisms.

The peg 102 attached to and extending from the main body 104 may be the component of the peg shifter 100 inserted in the installation holes 212*a-b* (see FIG. 1F) for mounting the pool gate 200. By way of example and not limitation, the peg 102 may be cylindrical having a round end that is inserted in the installation hole 212*a-b*. Alternatively, the peg may have a prism shape (e.g., rectangular, square, or triangular prism). As shown in FIGS. 6A, the center of the cross-section of the peg 102 may be designed to be at the center of the combined cross-section of the main body 104 and shim 106, and the device in general. As shown in FIGS. 6B-C, the center of the peg 102 may be shifted off-center, depending on which longitudinal side 104*a-b* the shim 106 is attached to the main body 104. Such off-center shifting may adjust the distance 103 between the pegs 102*a-b* (see FIG. 1A) to distance 103*a* (see FIG. 1D) that equals the distance 105 between the installation holes 212*a-b*, as described elsewhere herein. By way of example and not limitation, the peg 102 may be made from a steel alloy, such as stainless steel. The peg 102 may be made from other types of metal alloys also, such as aluminum and titanium, or from a rigid polymer material.

As shown in FIGS. 2 and 3B, and by way of example and not limitation, the second longitudinal side 104*b* of the main body 104 may have a notch 108 proximate to the edge closest to the insertion hole 107 and the peg 102. The notch 108 may serve as an indication of distinguishing the second longitudinal side 104*b* from the first longitudinal side 104*a*, especially when the peg shifter 100 is inserted into the receiving cavity 214*a-b* (see FIG. 1A) of the pool gate 200. The distinguishing of the first and second longitudinal sides 104*a-b* created by the notch 108 may be necessary since the attachment of the shim 106 to the second longitudinal side 104*b* of the main body 104 may off-center the peg 102 to compensate for the discrepancy between the distances 103, 105 of the pegs 102*a-b* and the installation holes 212*a-b*. When the user sees that the shim 106 (see FIG. 6A) is attached to the side of the main body 104 without the notch 108, the user may know that the peg 102 is centered relative to the main body 104. When the user sees that the shim 106 is attached to the side of the main body 104 with the notch 108 (see FIGS. 6B-C), the user may know that the peg 102 is off-centered. The user may determine such relative positioning of the peg 102 with the rest of the body of the device even when the peg shifter 100 is coupled to a receiving cavity 214*a-b* since the notch 108 is located on the edge of the main body 104 closest to the peg 102 and visible when the peg shifter 100 is inserted within such cavity. Alternatively, the notch 108 may be on the first longitudinal side 104*a* instead of the second longitudinal side 104*b*.

As shown in FIGS. 3A-B, and by way of example and not limitation, an engagement hole 110 may extend through the main body 104 of the peg shifter 100 from the first longitudinal side 104*a* to the second longitudinal side 104*b*. Alternatively, and depending on case of manufacturing, there may be two engagement holes 110, one engagement hole 110 on each longitudinal side 104*a-b* of the main body 104. The engagement hole 110 may be located close to the back end of the main body 104, the back end being opposite to the front end of the main body 104 having the insertion hole 107 (see FIG. 2). When the peg shifter 100 is inserted in a receiving cavity 214*a-b* of the pool gate 200 (see FIG. 1A), the engagement hole 110 on the peg shifter 100 may align with the engagement hole 205 of the receiving cavity 214*a-b* within the vertical pole 204*a-b* of the pool gate 200. Consequently, one or more screws or pins may be used to fasten the peg shifter 100 to the receiving cavity 214*a-b* using the engagement hole 110 of the peg shifter 100 and the engagement hole 205 of the receiving cavity 214*a-b*. By way of example and not limitation, the engagement hole 110 on the main body 104 may be threaded. As shown in FIG. 2, the shim 106 may also have an engagement hole 110*a* to align with the engagement hole 110 of the main body 104, as described elsewhere herein.

Referring now to FIG. 3C, the shim 106 described elsewhere herein is shown with different body thicknesses 116*a-b*. As shown in FIG. 4, the shim 106 may have the same shape and surface dimensions as the first and second longitudinal sides 104*a-b* (i.e., rectangular faces) of the main body 104. By way of example and not limitation, the shim 106 may have one or more coupling tabs 114 designed to engage with the coupling holes 112*a-b* on the different longitudinal sides 104*a-b* of the main body 104. As a result, the shim 106 may be attached to one of the longitudinal sides 104*a-b* of the main body 104 for adjusting the peg 102 in the correct position for the installation of the pool gate 200 (see FIGS. 1D-D). By way of example and not limitation, the one or more coupling tabs 114 on the shim 106 may be part of an annular snap-fit joint coupling mechanism between the main body 104 and the shim 106, which the other part such joint fitting may be the coupling holes 112*a-b* on the main body 104. By way of example and not limitation, the shim 106 may have between one to six coupling tabs 114 on one rectangular surface of such component. Alternatively, the placement of the coupling holes 112*a-b* may be reversed with the coupling tabs 114 where one or more coupling holes 112*a-b* may be on the shim 106 and the longitudinal sides 104*a-b* of the main body may each have coupling tabs 114. Other coupling mechanisms between the main body 104 and the shim 106 are also contemplated herein, such as magnetic coupling or the usage of fasteners (screws or bolts) and fastening holes between the two components.

As shown in FIG. 3C, and by way of example and not limitation, the shims 106*a-c* may come in different body thicknesses 116*a-c*. The body thickness 116*a-c* of a shim 106*a-c* may be measured as the thickness between the two rectangular faces of the shim 106*a-c*. The shims 106*a-c* may come in different thicknesses 116*a-c* to allow for displacing the peg 102 away from the center of the peg shifter 100 at different distances. These different types of thicknesses may allow for more variety for correcting distance inequalities between the peg distance 103 (sec FIGS. 1A-B) and the installation hole distance 105. By way of example and not limitation, the shims 106*a-c* may come in small 116*a*, intermediate 116*b*, and large 116*c* thicknesses. By way of example and not limitation, the small thickness 116*a* of the thin shim 106*a* may be between 0.05 to 0.124 inches. By way of example and not limitation, the intermediate thickness 116*b* of the intermediate shim 106*b* may be between 0.125 and 0.24 inches. By way of example and not limitation, the large thickness 116*c* of the large shim 106*c* may be between 0.25 and 0.33 inches. Consequently, the shim thickness of a shim may be greater than 0.05 inches. Additionally, the shim thickness of a shim may be less than 0.33 inches. By way of example and not limitation, the shim 106 (see FIG. 4) may be made from the same material as the main body 104 of the peg shifter 100, as described elsewhere herein.

Although so far it has been contemplated herein the attachment of one shim 106 on one longitudinal side 104*a-b* of the main body 104 to adjust the positioning of the peg 102 of the peg shifter 100, both the first and second longitudinal sides 104*a-b* may alternatively have a shim 106 attached. As a result, the positioning of the peg 102 may be changed relative to the center of the peg shifter 100 by removing one of the two shims 106 attached to the first and second longitudinal sides 104*a-b* of the main body 104. The peg 102 may be shifted leftwards or rightwards relative to a corresponding installation hole 212*a-b* (see FIG. 1D) by removing one of the two shims 106 attached to the first and second longitudinal sides 104*a-b* of the main body 104.

Figure 5:
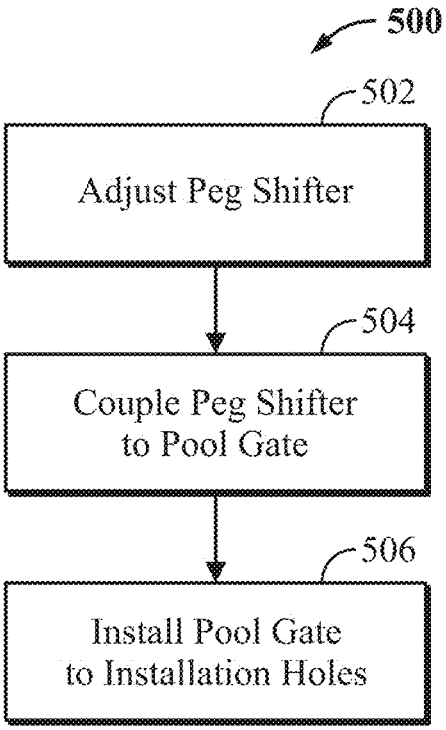
FIG. 5 shows a block diagram of a method of using one or more peg shifters to install a pool gate.
Figure 6A:
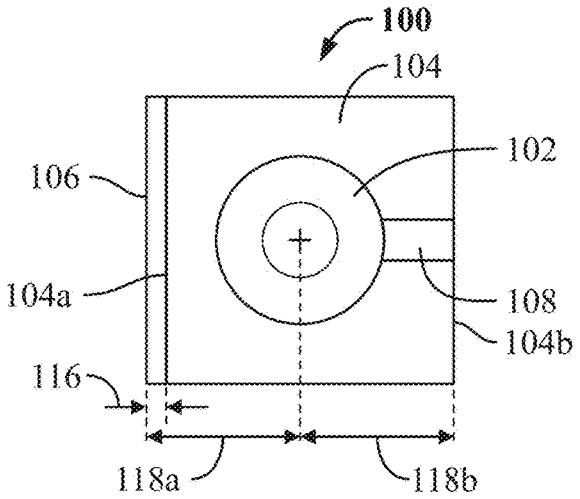
FIG. 6A shows a front view of the peg shifter.
Figure 6B:
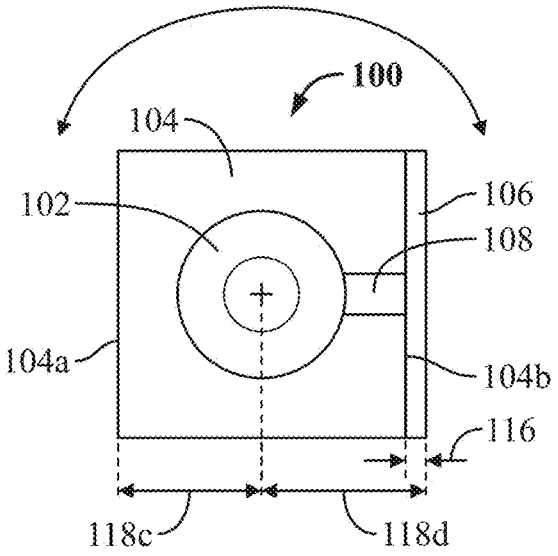
FIG. 6B shows a second front view of the peg shifter with the shim adjusted.
Figure 6C:
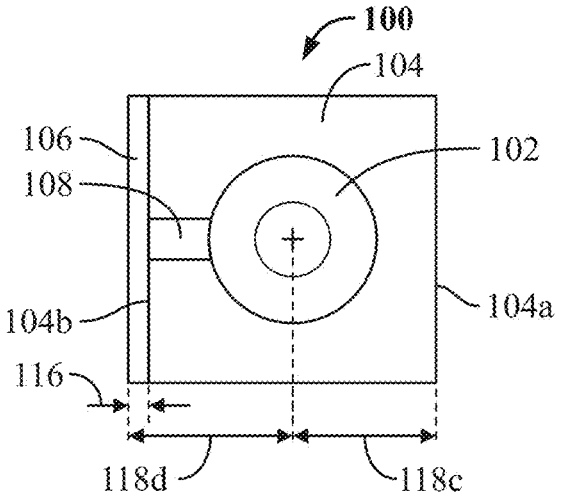
FIG. 6C shows a third front view of the peg shifter with the device rotated.

Referring now to FIG. 5, a block diagram of a method 500 of using the peg shifter 100 to properly install a pool gate 200 is shown. As shown in FIG. 1A, the distance 103 between the pegs 102*a-b* used for installing the pool gate 200 may differ from the distance 105 between the installation holes 212*a-b* on the ground without the usage of the adjusting functions of the one or more peg shifters 100*a-b*. Consequently, at least one peg 102*b* may not align with an installation hole 212*b* (see FIG. 1B). By way of example and not limitation, the general overview of the method 500 of using the peg shifter 100 to install the pool gate 200, by making the aforementioned two distances equal to each other, is shown. Such method 500 may include but not be limited to, adjusting the peg shifter 502 (see FIG. 5), coupling peg shifter to pool gate 504, and installing pool gate to installation holes 506. Some preliminary steps may be needed before implementing the process outlined in the block diagram of FIG. 5. By way of example and not limitation, some of these preliminary steps may include drilling the installation holes 212*a-b* (see FIG. 1A) and measuring the distance 105 between the installation holes 212*a-b*. The measuring the distance 105 between the installation holes 212*a-b* may be necessary to determine how to adjust the one or more peg shifters 100*a-b* to compensate for any difference in distances.

In block 502 of FIG. 5, and by way of example and not limitation, the process adjusts the peg shifter 100. With further reference to FIGS. 6A-C, the front-view of the peg shifter 100 in different adjustment orientations is shown. Such front-views show the perspective as if a person is looking straight towards the front round end of the peg 102. By way of example and not limitation, the adjustment of the peg shifter 100 may be seen as removing the shim 106 from one side of the main body 104 and reattaching the component to the opposite side and rotating the peg shifter 100, if needed. FIGS. 6A-C show how the peg shifter 100 may be used when the distance 103 between the pegs 102*a-b* shown in FIG. 1A are equal, greater than, or less than the distance 105 between the installation holes 212*a-b*, respectively. The object of block 502 in the process may be to adjust the distance between the pegs 102*a-b* (see FIG. 1A) to an adjusted distance 103*a* (see FIG. 1D) equaling the distance 105 between the installation holes 212*a-b*.

As shown in FIG. 6A, the peg 102 of the peg shifter 100 may be centered about the cross-section of the whole device (i.e., the main body 104 and the shim 106 combined). By way of example and not limitation, the shim 106 may be attached to the first longitudinal side 104*a* of the main body 104 when the peg 102 is centered about the square cross-section of the whole device. In the centered orientation, a first horizontal distance 118*a* may be measured between the left edge of the device and the cross-sectional center of the peg 102, the left edge being the outer surface of the shim 106 attached to the first longitudinal side 104*a* of the main body 104. A second horizontal distance 118*b* may be measured between the right edge of the device and the center of the peg 102, the right edge of the device being the second longitudinal side 104*b* of the main body 104. The first horizontal distance 118*a* may equal the second horizontal distance 118*b* in the centered orientation shown in FIG. 6A. Such orientation of the peg shifter 100 may be used when the installation holes 212*a-b* are drilled accurately to align with the vertical poles 204*a-b* (see FIG. 1D) of the pool gate 200, and no adjustment of the pegs 102*a-b* are needed. No adjustments may be needed since the second distance 103*a* of the pegs 102*a-b* is already achieved and equals the distance 105 between the installation holes 212*a-b* when the pegs 102*a-b* of the peg shifters 100*a-b* are in their original centered position.

If the distance 105 of the installation holes 212*a-b* shown in FIG. 1A is less than the distance 103 between the two pegs 102*a-b* coupled to the pool gate 200 (which is not actually the case in FIG. 1A), then at least one of the pegs 102*a-b* may be shifted inwards using the adjusting functions of the peg shifters 100*a-b*. As shown in FIG. 6B, and by way of example and not limitation, the shim 106 may be removed from the first longitudinal side 104*a* and attached to the second longitudinal side 104*b* to shift the peg 102 off-center, leftwards, and inwards, by a distance equaling the shim thickness 116. With such adjustment of the shim 106, the center of the peg 102 may be shifted leftwards and inwards relative to the combined cross-section of the base of the main body 104 and the thickness 116 of the shim 106. With respect to the second peg shifter 100*b* of FIG. 1A, such leftward shift of the peg may decrease the distance between the pegs 102*a-b* down to the distance between the installation holes 212*a-b* and allow the pool gate 200 (see FIG. 1F) to be mounted properly.

In the shifted leftward orientation of FIG. 6B, a third horizontal distance 118*c* may be measured from the first longitudinal side 104*a* of the main body 104 (i.e., the now modified left edge of the device) to the center of the peg 102. Also, a fourth horizontal distance 118*d* may be measured from the outer surface of the shim 106 attached to the second longitudinal side 104*b* (i.e., the now modified right edge of the device) to the center of the peg 102. The third horizontal distance 118*c* may be less than the fourth horizontal distance 118*d* by a difference of the thickness 116 of the shim 106.

By way of example and not limitation, such shifting and inwards adjustment of the peg 102 may be applied to one or both pegs 102*a-b* shown in FIG. 1D depending on how much distance compensation is needed to modify peg distance 103*a* to equal to the installation hole distance 105. By way of example and not limitation, the second longitudinal side 104*b* may have the notch 108 to distinguish such side from the first longitudinal side 104*a*. By way of example and not limitation, the different shim thicknesses 116*a-c* (see FIG. 3C) described elsewhere herein may be used for shifting the peg 102 off-center depending on how much distance the peg 102 needs to be displaced.

If the distance 105 of the installation holes 212*a-b* shown in FIG. 1A is greater than the distance 103 between the two pegs 102*a-b* coupled to the pool gate 200 (which is the case in FIG. 1A), then at least one of the pegs 102*a-b* may be shifted outwards using the adjusting functions of the one or more peg shifters 100*a-b*. As shown in FIGS. 6B-6C, the peg shifter 100 of FIG. 6B having the shim 106 attached to the second longitudinal side 104*b* may be rotated by 180-degrees to make the off-centered peg 102 shift rightwards by a distance equaling the shim thickness 116. With such adjustment of the peg shifter 100, the center of the peg 102 may be shifted rightwards relative to the combined cross-section of the base of the main body 104 and the thickness 116 of the shim 106. With respect to the second peg shifter 100*b* of FIG. 1A, such rightward and outward shift of the peg may increase the distance between the pegs 102*a-b* to distance 103*a* (see FIG. 1D) up to the distance 105 between the installation holes 212*a-b* and allow the pool gate 200 (see FIG. 1F) to be mounted properly.

As shown in FIG. 6C, the third horizontal distance 118*c* and the fourth horizontal distance 118*d* may also now switch orientation. The 180-degree rotation of the peg shifter 100 shown in FIGS. 6B-C may shift the peg 102 rightwards since the third horizontal distance 118*c* may be less than the fourth horizontal distance 118*d* by a difference of the thickness 116 of the shim 106. Similar to shifting the peg 102 leftwards in FIG. 6B, the different shim thicknesses 116*a-c* (see FIG. 3C) described elsewhere herein may be used for shifting the peg 102 off-center, rightwards, and outwards, depending on how much distance the peg 102 needs to be displaced. The notch 108 on the second longitudinal side 104*b* may also allow the user to keep track of which way the peg 102 is being shifted. By way of example and not limitation, the rotation of the peg shifter of FIG. 6B by 180-degrees to shift the peg 102 rightwards and outwards may be applied to one or both of the peg shifters 100 in FIG. 1D depending on how much distance compensation is needed to modify peg distance 103*a* to equal to the installation hole distance 105.

Although so far it has been contemplated herein the attachment of one shim 106 on one longitudinal side 104*a-b* of the main body 104 to adjust the positioning of the peg 102 of the peg shifter 100, both the first and second longitudinal side 104*a-b* may alternatively have a shim 106 attached. As a result, the positioning of the peg 102 may be changed relative to the center of the peg shifter 100 by removing one of the two shims 106 attached to the first and second longitudinal sides 104*a-b* of the main body 104. The peg 102 may be shifted leftwards or rightwards relative to a corresponding installation hole 212*a-b* (sec FIGS. 1A and 1D) by removing one of the two shims 106 attached to the first and second longitudinal sides 104*a-b* of the main body 104.

Another method of adjusting the positioning of the one or more pegs 102*a-b* may be to remove the shim 106 from the main body 104 and replacing such shim 106 with a shim 106*a-c* having a different body thickness 116*a-b* (see FIG. 3C) on the same side of the main body 104. In other words, the positioning of the shim 106, whether on the first or second longitudinal side 104*a-b*, may not be changed. Rather, more or less body thickness is added to the cross-section of the peg shifter via the usage of a different shim 106 having a different body thickness 116*a-c* to offset the peg 102 in the desired position, without changing the position of the shim 106 relative to the main body 104.

Referring back to FIG. 5, block 504 shows the process coupling the one or more adjusted peg shifters 102*a-b* (see FIGS. 1A and 1D) to the pool gate 200. After maintaining or modifying the orientation of the shim 106 and the peg shifter 100, shown in FIGS. 6A-C, the one or more peg shifters 100*a-b* (see FIGS. 1A and 1D) may be inserted into the receiving cavities 214*a-b* of the pool gate 200. By way of example and not limitation, each receiving cavity 214*a-b* may have a peg shifter 100*a-b* inserted therein, and each peg shifter 100*a-b* may be modified, as described elsewhere herein, to achieve the adjusted peg distance 103*a* (see FIG. 1D) that equals the installation hole distance 105. Alternatively, only one receiving cavity 214*a-b* may have a peg shifter, and the other receiving cavity 214*a-b* may have a conventional mounting mechanism therein.

The pegs 102*a-b* of the peg shifters 100 may extend downwards and out of the receiving cavities 214*a-b*. Each peg shifter 100*a-b* may be affixed to the receiving cavities 214*a-b* by inserting one or more screws or pins through the engagement hole 205 on the outside of the receiving cavity 214*a-b* and also inserted inside the corresponding engagement holes 110, 110*a* (sec FIGS. 2 and 3A-B) on the main body 104 and the shim 106 of the peg shifter 100*a-b*. The engagement hole 205 of the receiving cavity 214*a-b* may align with the corresponding engagement holes 110, 110*a* on the peg shifters 100*a-b* to fasten the device to the bottom of the vertical poles 204*a-b* of the pool gate 200.

In block 506 of FIG. 5, the process installs the pool gate 200 to the installation holes 212*a-b*. As shown in FIG. 1D-E, the pegs 102*a-b* may align with the installation holes 212*a-b* by modifying one or both of the peg shifters 100*a-b* located proximate to the sides of the pool gate 200. In other words, the adjusted distance 103*a* between the pegs 102*a-b* may equal the distance 105 between the installation holes 212*a-b*. The pegs 102*a-b* may then be inserted inside the installation holes 212*a-b* to stand the pool gate 200 upright and at a stable position, as shown in FIG. 1F.

Figure 7:
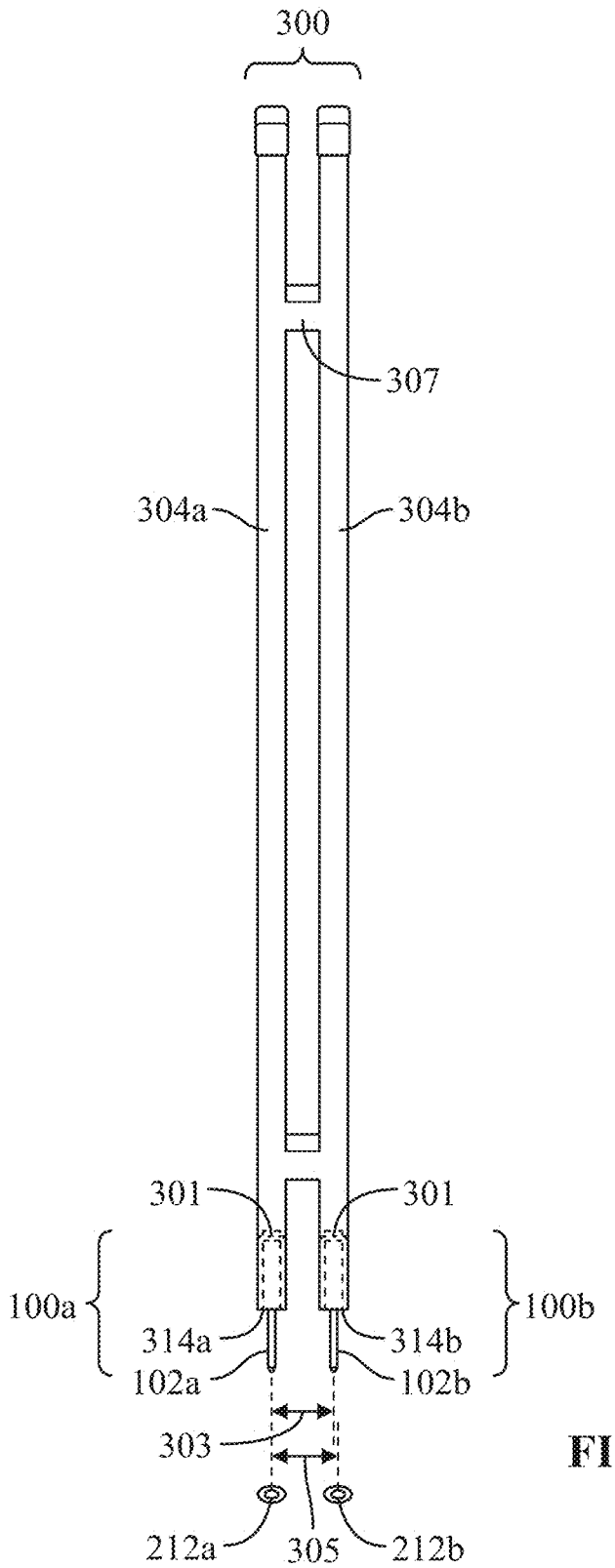
FIG. 7 shows the one or more peg shifter used with a gate post for installation.

As shown in FIG. 7, the one or more peg shifters 100*a-b* may also be used with other structural components of a pool fence, such as a gate post 300. By way of example and not limitation, the gate post 300 may similarly be mounted to the ground using pegs 102*a-b* of the peg shifters 100*a-b* and installation holes 212*a-b*. Consequently, the distance 303 between the pegs 102*a-b* coupled to the receiving cavities 314*a-b* of the gate post 300 may need to equal to the distance 305 of the installation holes 212*a-b*. The peg shifter 100 and its functions described elsewhere herein may be used to compensate for any discrepancy between the two aforementioned distances. By way of example and not limitation, the gate post 300 may have two column poles 304*a-b* linked by a horizontal pole 307, where each column pole 304*a-b* has a receiving cavity 314*a-b* for receiving the peg shifter 100*a-b* having the adjustable pegs 102*a-b* extending outwards. By way of example and not limitation, the column poles 304*a-b* may each have engagement holes 301 for a screw or pin to be inserted therethrough and fasten the peg shifters 100*a-b* to the receiving cavities 314*a-b*.

The usage of the peg shifter 100 may not just be limited to usage with the pool gate 200, gate post 300, or pool fence. The usage of the peg shifter 100 may also apply to other applications requiring the correction of distance for attaching a structure to the installation holes in the ground using pegs 102*a-b*.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A peg shifter for coupling to a receiving cavity of a pool gate, comprising:

a main body having a rectangular shape, the main body having a first longitudinal face and a second longitudinal face, and a base therebetween, the first and second longitudinal faces being opposing lateral faces of the rectangular shape;

one or more engagement members on the first longitudinal face of the main body;

one or more second engagement members on the second longitudinal face of the main body;

a peg extending from the base; and a shim having a thickness and one or more corresponding engagement members on an outer surface of the shim, the one or more corresponding engagement members configured to removably couple to the one or more engagement members of the first longitudinal face of the main body and also removably couple to the one or more second engagement members on the second longitudinal face of the main body;

wherein when the shim is coupled to the first longitudinal face of the main body, the peg is centered about a cross-section of the peg shifter defined by the base of the main body and the thickness of the shim; and wherein when the shim is coupled to the second longitudinal face of the main body, the peg is shifted off-center about the cross-section of the peg shifter by a distance equaling the thickness of the shim.

2. The peg shifter of claim 1, wherein an insertion hole extends through the main body from the first longitudinal face to the second longitudinal face.

3. The peg shifter of claim 1, wherein the thickness of the shim ranges between 0.1 to 0.2 inches.

4. The peg shifter of claim 1, further comprising a notch on the second longitudinal face of the main body and proximate to the peg.

5. The peg shifter of claim 1, wherein the one or more engagement members and the one or more second engagement members on the main body are coupling holes and the one or more corresponding engagement members on the shim are coupling tabs.

6. The peg shifter of claim 1, wherein the main body is made from a thermoplastic and the peg is made from stainless steel.

7. The peg shifter of claim 1, wherein when the shim is coupled to the main body, the cross-section of the peg shifter is a square shape.

8. The peg shifter of claim 1, wherein the shim is a first shim and the peg shifter further comprises a second shim having a second thickness that is greater than the first thickness of the first shim.

9. The peg shifter of claim 1, wherein the coupling of the one or more corresponding engagement members on the shim with the one or more engagement members on the first longitudinal face of the main body is done through an annular snap-fit joint mechanism.

10. The peg shifter of claim 9, wherein the coupling of the one or more corresponding engagement members on the shim with the one or more second engagement members on the second longitudinal face of the main body is done through a second annular snap-fit joint mechanism.

11. A method for using a peg shifter to install a pool gate to a ground floor, comprising:

detaching a removable shim from a main body of the peg shifter by separating one or more corresponding engagement members that are on the removable shim from one or more engagement members on a first longitudinal face of the main body, the main body having a rectangular shape;

attaching the removable shim to a second longitudinal face of the main body by coupling the one or more corresponding engagement members of the shim to one or more second engagement members on the second longitudinal face of the main body, the second longitudinal face being opposite to the first longitudinal face of the main body, wherein attaching the removable shim to the second longitudinal face of the main body shifts a first peg extending from the main body off-center relative to a cross-section defined by a base of the main body and a body thickness of the shim;

coupling the peg shifter to a first receiving cavity located on a bottom section of the pool gate such that the first peg extends downwards from the pool gate;

coupling a second peg to a second receiving cavity located on the bottom section of the pool gate such that the second peg extends downwards from the pool gate; and inserting the first peg into a first installation hole and inserting the second peg into a second installation hole on the ground floor.

12. The method of claim 11, wherein the peg shifter is coupled to the first receiving cavity using an insertion hole on the peg shifter and a corresponding insertion hole extending through the first receiving cavity.

13. The method of claim 11, further comprising rotating the peg shifter by 180-degrees after attaching the removable shim to the second longitudinal face of the main body.

14. The method of claim 11, wherein the second peg is attached to a second peg shifter for coupling to the second receiving cavity located on the bottom section of the pool gate.

15. The method of claim 11, wherein the first longitudinal face of the main body is distinguishable from the second longitudinal face by a notch on the second longitudinal face.

16. The method of claim 11, wherein the body thickness of the shim ranges between 0.1 to 0.2 inches.

17. The method of claim 11, wherein the one or more engagement members and the one or more second engagement members on the main body are coupling holes and the one or more corresponding engagement members on the shim are coupling tabs.

18. The method of claim 11, wherein the main body is made from thermoplastic and the first peg is made from stainless steel.

19. The method of claim 11, wherein detaching of the removable shim from the first longitudinal face of the main body is done through an annular snap-fit joint mechanism between the one or more corresponding engagement members on the removable shim and the one or more engagement members on the first longitudinal face of the main body.

20. The method of claim 19, wherein attaching of the removable shim to the second longitudinal face of the main body is done through a second annular snap-fit joint mechanism between the one or more corresponding engagement members on the removable shim and the one or more second engagement members on the second longitudinal face of the main body.

* * * * *